United States Patent [19]

Wehking et al.

[11] Patent Number: 4,842,429

[45] Date of Patent: Jun. 27, 1989

[54] TYPE FACE STRIKING SYSTEM IN AN OFFICE WRITING MACHINE

[75] Inventors: Hans Wehking, Jerxheim; Manfred Gottschlich, Braunschweig, both of Fed. Rep. of Germany

[73] Assignee: AEG Olympia AG, Wilhelmshaven, Fed. Rep. of Germany

[21] Appl. No.: 558,031

[22] Filed: Dec. 5, 1983

[30] Foreign Application Priority Data

Dec. 4, 1982 [DE] Fed. Rep. of Germany ..... 3244936

[51] Int. Cl.[4] ..... B41J 9/42

[52] U.S. Cl. ..... 400/157.2; 101/93.02; 101/93.29

[58] Field of Search ..... 101/93.29, 93.32, 93.33, 101/93.34, 93.48, 93.02, 93.19, 93.29, 93.48; 400/157.2; 335/234, 266

[56] References Cited

U.S. PATENT DOCUMENTS

| | | | |
|---|---|---|---|
| 3,905,294 | 9/1975 | Barrus et al. | 101/93.48 |
| 4,273,039 | 6/1981 | Luo et al. | 101/93.02 |
| 4,306,207 | 12/1981 | Tada et al. | 335/234 |
| 4,348,119 | 9/1982 | Carson, Jr. et al. | 101/93.02 |
| 4,429,342 | 1/1984 | Heider | 101/93.48 X |

FOREIGN PATENT DOCUMENTS

| | | | |
|---|---|---|---|
| 060969 | 9/1982 | European Pat. Off. | 101/93.34 |
| 3038881 | 5/1982 | Fed. Rep. of Germany . | |

OTHER PUBLICATIONS

IBM Technical Disclosure Bulletin, W. T. Pimbley, Settle Out Control for Moving Coil Print Hammer, 11-78, vol. 21, No. 6, pp. 2283 and 2284.

*Primary Examiner*—David B. Wiecking
*Attorney, Agent, or Firm*—Spencer & Frank

[57] ABSTRACT

A type face striking system for striking a type face to produces an imprint on a record carrier in a writing machine, the system including; an electromagnetically actuatable printing hammer movable under the influence of an electrically generated magnetic field between a rest position and a striking position for striking the type face; an actuating device including a magnetic field producing means in the form of a conductor coil connected for receiving an operating voltage for producing the electrically generated magnetic field; and a control unit connected to the coil and operative for successively applying thereto: a voltage pulse of a first polarity for causing the actuating device to produce a magnetic field which effects movement of the hammer from its rest position to its striking position; and a voltage pulse of a second polarity, opposite to the first polarity, for causing the actuating device to produce a magnetic field which effects movement of the hammer from its striking position toward its rest position.

6 Claims, 1 Drawing Sheet

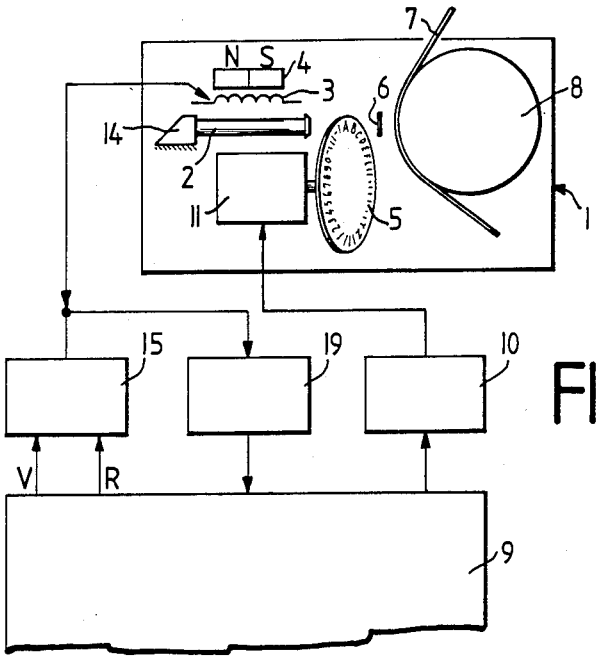
FIG.1
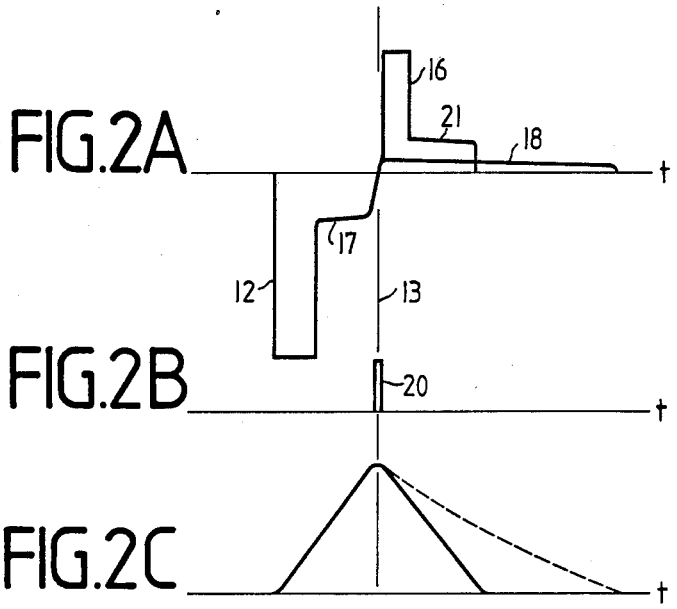
FIG.2A
FIG.2B
FIG.2C

TYPE FACE STRIKING SYSTEM IN AN OFFICE WRITING MACHINE

BACKGROUND OF THE INVENTION

The present invention relates to a type face striking system for a typewriter or similar machine of the type which includes an electromagnetically actuated printing hammer.

In such electromagnetic striking system, the printing hammer is accelerated, by means of a short voltage pulse applied to a winding, from its rest position to its striking position. Upon reaching the striking position, the hammer drives a type face to make an imprint on a record carrier via an inked ribbon. The type face to be struck is here disposed, for example, directly on the printing hammer or on a type carrier, for example a daisy wheel, which must be properly positioned before the imprint is made.

The return of the printing hammer into its rest position is then effected by the kinetic energy from impact on the printing abutment and is aided by the force of a spring if a faster return is necessary for faster reusability of the printing hammer. However, the presence of such a spring is a drawback during the striking movement, because the resetting force of this spring must then additionally be overcome.

So-called electrodynamic striking systems, such as disclosed, for example, in DE-OS [German Laid-open Application] 3,038,881, laid open on May 19th, 1982, avoid this drawback. Here, permanent magnets generate a magnetic field and the printing hammer is mounted so as to be movable in the striking direction within this field. Additionally, a winding is provided to which is applied the voltage pulse which actuates the striking movement. The magnetic field generated by the winding, and acting in the opposite direction to the field produced by the permanent magnets, produces an acceleration of the printing hammer to the striking position, and the return movement of the printing hammer into the rest position, when the voltage pulse in the winding is terminated, is aided by the magnetic field of the permanent magnets.

SUMMARY OF THE INVENTION

It is an object of the present invention to actuate the printing hammer of a striking system of the above-mentioned type in such a manner that successive striking movements can take place at a higher rate, i.e. in more rapid succession.

The above and other objects according to the invention are achieved by the provision of a novel type face striking system for striking a type face to produce an imprint on a record carrier in a writing machine, which system includes: an electromagnatically actuatable printing hammer movable under the influence of an electrically generated magnetic field between a rest position and a striking position for striking the type face; actuating means including magnetic field producing means in the form of a conductor coil connected for receiving an operating voltage for producing the electrically generated magnetic field; and control means connected to the coil and operative for successively applying thereto: a voltage pulse of a first polarity for causing the actuating means to produce a magnetic field which effects movement of the hammer from its rest position to its striking position; and a voltage pulse of a second polarity, opposite to the first polarity, for causing the actuating means to produce a magnetic field which effects movement of the hammer from its striking position toward its rest position.

The advantages of the present invention are, in particular: that a faster acting printing mechanism can be created because the printing hammer is moved more rapidly out of the region of the type carrier, so that it becomes possible to begin more quickly to set the type carrier to a new type face to be printed; and that the printing hammer reaches its rest position more quickly to be available for the actuation of a new imprint.

According to a further advantageous feature of the invention, the application of the voltage pulse generating the return current is made dependent on the detection of the arrival of the printing hammer in the striking position, so that the moment of initiation of the return current can be placed at an optimum instant. Thus the operating sequence need no longer be dependent on the distance between printing abutment and printing hammer, on the thickness and hardness of the record carrier, or on manufacturing and operating tolerances.

Further advantages of the invention become evident from the description below of one preferred embodiment of the invention.

BRIEF DESCRIPTION OF THE DRAWING

FIG. 1 is a block circuit diagram of the preferred embodiment.

FIGS. 2A, 2B and 2C are signal waveform diagrams illustrating the operation of the device of FIG. 1.

DESCRIPTION OF THE PREFERRED EMBODIMENTS

The block circuit diagram of FIG. 1 shows the electromagnetic striking system of a typewriter as well as the associated control device, together with the details required for an understanding of the invention. The striking system 1 is of the so-called dynamic type which includes, in addition to a printing hammer 2, a winding 3, and a permanent magnet 4, with the winding 3 being disposed on printing hammer 2. Hammer 2 is mounted in the magnetic field of the permanent magnet 4 so as to be movable in the striking direction, which is horizontal, and to the right in the view of FIG. 1. A voltage pulse of proper polarity applied to winding 3 causes the printing hammer 2 to move suddenly in the striking direction, toward the previously set printing type face of a type carrier 5, in the form of a daisy wheel, causing the selected character to be printed in a known manner by means of an inked ribbon 6 onto a record carrier 7 disposed in front of a printing abutment, or platen, 8.

The setting of type carrier 5 to the respective type face to be printed, as well as the application of the voltage pulse to winding 3 so as to actuate the type imprint, are controlled by a control device 9 formed, likewise in a known manner, of a microcomputer. In order to cause the type face to produce an imprint on record carrier 7, control device 9 first supplies the required actuation signals to a motor actuation circuit 10 which actuates the setting motor 11 until type carrier 5 has been brought to the position in which the selected type face has been set into the striking position. Then, or shortly before the termination of the setting operation, the control device 9 delivers an actuation signal to an electronic switch 15 which applies a voltage pulse 12, shown in FIG. 2A, to winding 3 so as to produce a current flow in winding 3 which then generates a magnetic field which interacts with the field of magnet 4 to generate a force in the striking direction.

This causes printing hammer 2 to be accelerated in the striking direction and to impact with a certain speed and energy on the rear of type carrier 5 so that the type face is caused to produce an impression and part of the energy is transferred to type carrier 5, inked ribbon 6, record carrier 7 and platen 8. The moment of impact is shown in FIG. 2A by line 13.

After impact, printing hammer 2 jumps back with the remaining energy and would return to its rest position against a rear abutment 14 aided by the magnetic field of permanent magnet 4. To accelerate this process, control device 9 gives a signal to electronic switch 15 to apply a voltage pulse 16 to winding 3, which produces current effective in the reverse direction to winding 3. Voltage pulse 16 is of the opposite polarity to pulse 12. Thus, printing hammer 2 is moved back at increased speed from the region of type carrier 5 and into its rest position at rear abutment 14.

For an optimum control of the moment at which the return pulse 16 is applied, use is made of the fact that the sequence of movement of printing hammer 2 induces a voltage in winding 3. The curve of this induced voltage, after the forward acceleration pulse 12 has been switched off, approximately has the shape of curve portion 17 shown in FIG. 2A and exhibits a voltage jump at the moment when printing hammer 2 arrives in the striking position, at line 13, due to printing hammer 2 stopping and reversing the direction of its movement. Without a subsequent voltage pulse of the opposite polarity which acts in the reverse direction, the induced voltage would then have approximately the form of the curve portion 18 until printing hammer 2 returns to its rest position.

Winding 3 is thus connected to a flank detector 19 which detects the voltage jump of the induced voltage when printing hammer 2 arrives in the striking position and converts it to an output signal 20, shown in FIG. 2B. Output signal 20 is fed to control device 9, which then emits the signal for applying voltage pulse 16 of the opposite polarity to electronic switch 15. Voltage pulse 16 is thus applied to winding 3 independently of the fluctuating influences of the type and thickness of the record carrier, of the distance of the platen, etc., immediately upon occurrence of the jump in the voltage induced in winding 3. Thus a voltage is induced at the end of voltage pulse 16, which has approximately the form shown at 21 in FIG. 2A.

To clarify the resulting faster return of printing hammer 2 into its rest position, FIG. 2C shows the displacement of printing hammer 2 represented by the height of the solid line curve over time t. The broken line curve portion represents the movement of hammer 2 during return to the rest position if no return pulse were applied.

The effect of the supply of a return pulse as described for the embodiment, as well as the detection of the optimum point in time for switching on the return current, is not limited to dynamic striking systems whose operation is based on the interaction of a field generated by a permanent magnet and a field generated electromagnetically. It also applies for all simple, electromagnetic striking systems. In particular, the detection of the moment of striking, which is of significance for the optimum instant at which the return current is actuated, can be effected in all striking systems in which a voltage corresponding to the movement of the hammer can be induced in a winding, either indirectly or directly. The use of a separate measuring winding, possibly in combination with a permanent magnet, provided solely to pick up a voltage induced by the hammer movement and intended for evaluation for control purposes, also leads to the desired success.

For the sake of completeness, it might also be noted that if the winding for the striking movement of the printing hammer is used as a sensing winding for the induced voltage, it may be necessary to provide a filter circuit or filter function which permits only voltage jumps after termination of the forward voltage pulse and before the beginning of the voltage pulse in the reverse direction to be used for the evaluation so that, for example, voltage jumps caused by the switching of the actuating voltage pulses will not actuate any undesired currents in the reverse direction. Also, it may be necessary to employ mechanical or electrical damping measures at the rear abutment 14 for printing hammer 2 so as to prevent annoying rebounding phenomena. This may be accomplished by the use of a voltage pulse, formed for example by an RC member, with a decaying characteristic for the current in the reverse direction.

It will be understood that the above description of the present invention is susceptible to various modifications, changes and adaptations, and the same are intended to be comprehended within the meaning and range of equivalents of the appended claims.

What is claimed is:

1. A type face striking system for striking a type face to produce an imprint on a record carrier in a writing machine, said system comprising:

an electromagnetically actuatable printing hammer movable under the influence of an electrically generated magnetic field between a rest position and a striking position for striking the type face;

actuating means including magnetic field producing means in the form of a conductor coil connected for receiving an operating voltage for producing the electrically generated magnetic field;

control means connected to said coil and operative for successively applying thereto: a voltage pulse of a first polarity for causing said actuating means to produce a magnetic field which drives said hammer from its rest position to its striking position; and a voltage pulse of a second polarity, opposite to the first polarity, initiated substantially immediately upon striking of the type face by said hammer, for causing said actuating means to produce a magnetic field which drives said hammer from its striking position toward its rest position; and means for detecting impact of said hammer against a type face when said hammer reaches its striking position and means for producing, in response to such detection, a signal which initiates production of the voltage pulse of a second polarity.

2. An arrangement as defined in claim 1 wherein said means for detecting comprises inductor means located in the vicinity of said hammer so that a voltage is induced in said inductor means by movement of said hammer and the induced voltage experiences an amplitude jump when said hammer strikes a type face, and said means for producing a signal is connected to respond to such voltage jump.

3. An arrangement as defined in claim 2 wherein said conductor coil of said actuating means constitutes said inductor means.

4. An arrangement as defined in claim 2 wherein said means for producing a signal comprises a pulse flank detector connected for producing such signal in response to occurrence of such voltage jump.

5. An arrangement as defined in claim 1 wherein: said striking system is an electrodynamic striking system; said actuating means further comprise magnetic field producing means in the form of a permanent magnet producing a magnetic field in the region of said conductor coil; the magnetic field generated by said coil interacts with the magnetic field produced by said magnet; and one of said magnetic field producing means is coupled for movement with said hammer.

6. An arrangement as defined in claim 5 wherein said one of said magnetic field producing means is mounted on said hammer, and the other one of said magnetic field producing means is stationary and is disposed along the path of movement of said hammer.

* * * * *